US012692717B2

(12) United States Patent
Messelis et al.

(10) Patent No.: US 12,692,717 B2
(45) Date of Patent: Jul. 28, 2026

(54) FENCE

(71) Applicant: GUARDIAR EUROPE BVBA, Zwevegem (BE)

(72) Inventors: Timothy Messelis, Zwevegem (BE); Stefanos Synodinos, Zwevegem (BE)

(73) Assignee: GUARDIAR EUROPE BVBA, Zwevegem (BE)

( * ) Notice: Subject to any disclaimer, the term of this patent is extended or adjusted under 35 U.S.C. 154(b) by 810 days.

(21) Appl. No.: 17/760,341

(22) PCT Filed: Dec. 17, 2020

(86) PCT No.: PCT/EP2020/086734

§ 371 (c)(1),
(2) Date: Aug. 8, 2022

(87) PCT Pub. No.: WO2021/164923

PCT Pub. Date: Aug. 26, 2021

(65) Prior Publication Data

US 2023/0123821 A1 Apr. 20, 2023

(30) Foreign Application Priority Data

Feb. 20, 2020 (GB) ..... 2002340

(51) Int. Cl.
*E04H 17/14* (2006.01)

(52) U.S. Cl.
CPC ..... *E04H 17/1439* (2013.01)

(58) Field of Classification Search
CPC . E04H 17/14; E04H 17/1413; E04H 17/1417; E04H 17/1426; E04H 17/143; E04H 17/1439
See application file for complete search history.

(56) References Cited

U.S. PATENT DOCUMENTS 2,218,953 A 10/1940 Gustafson
6,375,166 B1 * 4/2002 Schall ..... E04H 17/1439 256/59

(Continued)

OTHER PUBLICATIONS

International Search Report and Written Opinion of International Application No. PCT/EP2020/086734 mailed Mar. 3, 2021.

(Continued)

*Primary Examiner* — Jonathan P Masinick

(74) *Attorney, Agent, or Firm* — Ping Wang; Kalos Athena Wang PLLC

(57) ABSTRACT

The present application provides a fence panel comprising: a plurality of upright members, and at least one rail connected to each of said upright members, wherein the at least one rail comprises: an external casing defining a rail channel and comprising at least one aperture, wherein each of the upright members extends through an aperture into the rail channel, and an inner plate that extends along at least part of the length of the rail channel, wherein the inner plate is at least partly enclosed by the external casing, wherein the inner plate comprises a flat portion comprising a plurality of openings that rests against the upright members and two angled portions connected to opposite sides of the flat portion and extending away from said upright members and wherein the plurality of upright members each comprise a projection that extends into one of said openings to connect said upright member to the rail.

25 Claims, 10 Drawing Sheets

(56) References Cited

U.S. PATENT DOCUMENTS

| | | | | |
|---|---|---|---|---|
| 7,384,025 | B2 * | 6/2008 | Lo | E04H 17/1439 256/65.13 |
| 7,384,026 | B2 | 6/2008 | Lo | |
| 7,635,115 | B2 * | 12/2009 | Lehmann | E04H 17/1447 256/22 |
| 7,677,535 | B1 * | 3/2010 | Lo | E04H 17/1439 256/65.01 |
| 8,356,801 | B2 * | 1/2013 | Howard | E04H 17/1439 256/22 |
| 8,695,949 | B2 * | 4/2014 | Stinson | E04H 17/143 256/64 |
| 8,833,737 | B2 * | 9/2014 | Langenwalter | E04H 17/1426 256/67 |
| 9,404,283 | B1 * | 8/2016 | Lo | E04H 17/1439 |
| 9,482,028 | B2 * | 11/2016 | Springborn | E04H 17/1439 |
| 9,797,158 | B2 * | 10/2017 | Springborn | E04F 11/1817 |
| 10,648,194 | B2 * | 5/2020 | Lo | E04H 17/1439 |
| 11,035,147 | B2 | 6/2021 | Burt et al. | |
| 12,018,506 | B1 * | 6/2024 | Lo | E04H 17/1465 |
| 2005/0045863 | A1 | 3/2005 | MacKay | |
| 2006/0081828 | A1 | 4/2006 | Gidseg | |
| 2007/0085066 | A1 | 4/2007 | Lo | |
| 2009/0065755 | A1 | 3/2009 | Sherstad | |
| 2010/0044662 | A1 | 2/2010 | Walmsley | |
| 2010/0065802 | A1 | 3/2010 | Lo | |
| 2010/0155683 | A1 | 6/2010 | Payne et al. | |
| 2010/0264388 | A1 | 10/2010 | Duffy et al. | |
| 2011/0155982 | A1 | 6/2011 | Duffy et al. | |
| 2011/0233499 | A1 | 9/2011 | Stinson | |
| 2013/0264532 | A1 * | 10/2013 | Goodman | E04H 17/1439 256/65.03 |
| 2014/0346422 | A1 | 11/2014 | Langenwalter et al. | |
| 2018/0030754 | A1 * | 2/2018 | Leone | E04H 17/168 |
| 2019/0211579 | A1 | 7/2019 | Burt et al. | |
| 2024/0352764 | A1 * | 10/2024 | Messelis | E04H 17/1439 |

OTHER PUBLICATIONS

Combined Search and Examination Report of Application No. GB2002340.4 mailed Aug. 7, 2020.

International Bureau, "International Preliminary Report on Patentability," Jan. 19, 2023.

* cited by examiner

FENCE

This application is a national stage application of International Patent Application No. PCT/EP2020/086734, filed Dec. 17, 2020, which claims priority to United Kingdom patent Application Nos. 2002340.4, filed Feb. 20, 2020. The entirety of all of the aforementioned applications is incorporated herein by reference.

FIELD

The present application concerns fence panels, fences, methods for assembling fences, and kits for assembling fences.

BACKGROUND

Fences are free standing structures designed to restrict and/or prevent movement across a boundary. One type of fence often used for civilian boundaries due to its aesthetic qualities is the picket fence. In general, picket fences include at least one, but often two or more, rails spanning across at least two adjacent fence posts embedded in the ground. Picket fences also include a number of upright members, usually evenly-spaced, extending across and connected to the rails and oriented generally parallel to the posts.

Typically in the art, the rails and the upright members are welded together. However, welding is susceptible to quality issues and requires specialist equipment. A fence that does not require any welding in its assembly is therefore desirable. This would give a cleaner coating with an improved aesthetic appeal and means that the fence can be more easily assembled without any complex tools and machinery.

Furthermore, fences are often used on terrains that are not flat but are inclined. In such scenarios, welded picket fences are unsuitable. Instead, one must use a picket fence that is rackable. Rackable fences work by adjusting the upright members relative to the rails of the fence, such that the angles between the upright members and the rails can be varied. This cannot be done if the joints are welded together. For many civilian applications it is therefore desirable to have a fence which is rackable.

It is also desirable for the fence to be manufactured in a cost-effective and facile way, and easily installed on site at a different location to where it was manufactured and/or assembled.

Various ways of connecting the upright members to the rails are known in the art, including the simple insertion of pins. For example, US2009065755 describes a barrier formed from at least one elongate rail comprising a rail channel and at least one vertical upright member, with each upright member including an aperture formed therein. A pin extending from a clip may be inserted into the aperture while the clip is welded to an inside surface of the rail channel. Alternatively, a pin may be inserted through the aperture while opposed ends of the pin are welded to an inside surface of the opposed side walls of the rail channel.

Alternatively, some arrangements in the prior art include complex internal structures within the rail channel, which interact with projections on the upright member. US2010044662 describes a self-racking fence panel comprising a pair of inverted U-shaped rails, each having a horizontal central wall with apertures for receiving a plurality of pales, a pair of outer side walls, and rigid or resilient integral internal return walls defining downwardly diverging ramped surfaces and a pair of recesses adjacent each aperture. Upright members comprising spring-biased pins are inserted through the apertures. The spring-biased pins, which are complex and expensive component parts, are compressed by the ramped surfaces until they lock in the recesses, thereby connecting the upright members to the rails.

Similarly, US2011155982 describes a fencing assembly adapted to be positioned between a pair of posts and mounted thereto. The assembly includes a plurality of elongate pickets and one or more rails extending transverse to the pickets. The pickets each have at least one protrusion formed or positioned thereon. The rails have an elongate channel formed on an inside portion thereof for cooperating with the protrusion, thereby forming a connection between the pickets and the rails. The pickets and railings are typically formed from extruded aluminium.

Further, US2010264388 describes a fencing assembly adapted to be positioned between and mounted to a pair of posts. The fencing assembly includes a plurality of pickets and a plurality of rails extending transverse to the pickets. The rails are coupled to the pickets by a protuberance on the rail which interacts with a recess on the picket, both of which may be formed by a press tool. Optionally, sliding covers are provided for concealing the connection between the pickets and the rails.

US2010155683 describes an alternative fence system, in which the upright members have a more complex shape, which significantly increases the cost of the arrangement. Each picket has a first connection region located substantially in the channel of the rail such that the first connection region is substantially prevented from passing through the corresponding aperture in the first surface of the rail, or otherwise leaving the rail channel. The connection region is a deformed section of the picket, which is wider in the cross-sectional direction than the rest of the picket.

It is also known to include additional components within the rail, in order to strengthen the arrangement and to attach the upright members. For example, US2006081828 describes a picket fence system wherein pickets are supported by a system which includes a picket support and strengthening bar and rail system.

US2014346422 describes a rackable fence with a rail, picket carrier, and plurality of pickets. The rail defines a rigid inverted U-shaped cross-section. The picket carrier includes a top span residing within and extending across the interior of the rail. The pickets are pivotally attached to the picket carrier and pivotable relative to the rail. The picket carriers are typically made from metal, extruded plastic, or injection moulded plastic. In all embodiments, the rail is located at the top and/or the bottom of the pickets.

However, the arrangements of the art typically include several complex parts that would not be straightforward to install or cheap to manufacture. Thus, there remains a need for rackable fencing which is more cost-effective and facile to manufacture, uses fewer components, and is easy to assemble and install without the need for complex tools and machinery. It is also desirable for the rail to be arranged such that it can be positioned at any point along the length of the upright members. The aim of the present invention is to address at least some, and preferably all, of these requirements.

According to a first aspect of the present invention, there is provided a fence panel comprising:

- a plurality of upright members, and
- at least one rail connected to each of said upright members, wherein the at least one rail comprises:

an external casing defining a rail channel and comprising at least one aperture, wherein each of the upright members extends through an aperture into the rail channel, and an inner plate that extends along at least part of the length of the rail channel, wherein the inner plate is at least partly enclosed by the external casing, wherein the inner plate comprises a flat portion comprising a plurality of openings that rests against the upright members and two angled portions connected to opposite sides of the flat portion and extending away from said upright members and wherein the plurality of upright members each comprise a projection that extends into one of said openings to connect said upright member to the rail.

The term "fence panel" is to be construed in accordance with the normal use of the word to relate to a panel that can be used in combination with fence posts to create a fence. The fence panel is therefore not self-supporting and is not sufficient to create a fence or other barrier alone, without some form of support.

The inventors have found that the fence panel of the present invention is straightforward and cheap to manufacture, with minimal and simple component parts (and fewer components than similar arrangements of the art), whilst still providing excellent structural security. Furthermore, the fence panel is rackable and requires no welding during assembly.

In particular, the inventors have found that the inner plate of the invention uses less material than similar arrangements of the art, and as such would be cheaper to manufacture, whilst still providing excellent structural security. Furthermore, the inventors have found that use of the inner plate of the invention yields fencing which is easier to assemble and manufacture.

The angled portions of the inner plate are directly connected to the flat portion. The angled portions may extend to or towards the same side of the external casing, which extends parallel to the upright members. The angled portions of the inner plate may be on the upper and lower opposed sides of the inner plate. The angled portions of the inner plate may extend along most or all of the length of the inner plate. The angled portions may each be in contact with the external casing.

The external casing may comprise at least one first aperture and at least one second aperture opposite the at least one first aperture, wherein each of the upright members extends through a first and second aperture and thereby extends through the rail channel. This allows the rail to be positioned at any point along the length of each upright member (for example along the top, middle or bottom of the upright members). Thus, multiple rails can be positioned at different heights of the fence panel.

Preferably, the external casing comprises a plurality of apertures such that each upright member extends through a different aperture. Said plurality of apertures may be a plurality of first apertures. The plurality of apertures ensures that each upright member is held in place and limits the extent to which the upright members have rotational freedom. The extent of the rotational freedom is at least partially dictated by the size of said apertures. The first apertures are preferably on an upper side of the external casing.

The terms "upper" and "lower" herein are intended to be construed with reference to the surface on which the fence panel is to be placed. Thus, the lower side is that closest to the surface, while the upper side is that furthest from the surface.

The external casing may comprise one aperture extending along at least part of the length thereof, such that all of the upright members extend through the same aperture. This aperture may be the second aperture. This aperture may extend along the entire length of the external casing. This aperture may be on a lower side of the external casing.

The combination of the plurality of first apertures and the single second aperture increases the ease with which the upright members are positioned relative to the rail, as each upright member only needs to be aligned with a first aperture. Such an arrangement is also cheaper and easier to assemble, whilst maintaining the stability of the upright members, which is provided by the first apertures.

The cross-section of an aperture may be greater than the cross-section of the upright member extending therethrough. For clarity, the term "cross-section" is used in this context to refer to the cross-section parallel to the side of the external casing comprising the aperture. This may be the case for all apertures in the external casing and is particularly important for the plurality of first apertures, if present. The cross-section of the aperture may be greater than the cross-section of the upright member in one dimension, or in all dimensions.

This permits rotation of the upright members around their projections, which would be impossible if the cross-sections of the apertures were equal to the cross-sections of the upright members, as the upright members would then fit tightly in the apertures with no room for movement. This also allows for insertion of the upright members into the external casing and through the rail channel, as it accounts for the size of the projection. The ease of assembly is also increased.

The external casing may have a rectangular cross-section. The external casing may comprise two sides parallel to the upright members and two sides perpendicular to the upright members. The dimensions of the external casing may be such that the sides of the external casing parallel to the upright members are longer than the side(s) of the external casing perpendicular to the upright members. Alternatively, the external casing may be described as generally having an inverted U-shaped cross-section, i.e. missing the lower side.

The external casing may comprise a lip adjacent to an aperture and extending into the rail channel. The lip may be connected to the external casing at the boundary between said external casing and the aperture. The aperture may be the one second aperture and the lip may extend along at least part of the second aperture. Preferably, the lip is connected to the side of the aperture closest to the inner plate.

The lip may be connected to the lower side of the external casing, which extends perpendicular to the upright members. Alternatively, the lip may be connected directly to the side of the external casing that extends parallel to the upright members. The lip may comprise a section angled towards the inside of the external casing, away from the lower side. The lip may extend partly over the aperture.

Advantageously, the lip may provide a channel in which an angled portion of the inner plate can rest. The lip may also ensure that the size of the cross-section of the aperture in the dimension perpendicular to the length of the rail channel is similar to the size of the cross-section of the upright members in the same dimension. This prevents movement of the upright members in this dimension, and thus improves stability of said upright members.

The lip may be angled at about 0° to about 80°, preferably about 20° to about 80°, more preferably about 20° to about 70°, most preferably about 30° to about 70°, relative to the side of the external casing comprising the aperture. The inventors of the present invention have found that such an angle provides optimal positioning of the inner plate inside the external casing to maximise stability and security, especially compared to arrangements of the art which are absent the lip, or have an angle greater than about 80°. A lip having this angle makes it more difficult to remove the top rail from the arrangement. The inventors of the present invention have also found that the external casing comprising a lip having such an angle is cheaper and easier to manufacture compared to arrangements of the art which have an angle greater than about 80°.

The inner plate may be in contact with the external casing such that a point of contact is interposed between a side of the external casing extending parallel to the upright member and the lip. Said point of contact may be between one of the angled portions and the external casing. This provides extra stability and security to the inner plate inside the external casing.

The external casing may be formed from metal, preferably steel, more preferably stainless steel.

The inner plate may comprise portions having a first width alternating with portions having a second width, wherein the first width is greater than the second width. The width of the inner plate may vary gradually between a portion having a first width and a portion having a second width, thereby forming a wave strip shape. The portions having a greater width may be formed integrally in the inner plate or may be formed by additional components attached to the inner plate.

Such a shape for the inner plate is advantageous because it costs less to manufacture than an inner plate in which the entire inner plate has the first width. Furthermore, a fence panel comprising an inner plate having a wave strip shape is easier to assemble as the weight of the inner plate is reduced. Additionally, because the contact area between the inner plate and the external casing is limited, the time taken to assemble the fence panel of the invention is reduced.

The inner plate may comprise a hole, optionally a slot hole, to secure said inner plate to the external casing. The inner plate may be screwed or bolted to the external casing via the hole. Therefore, the external casing may also have a hole, optionally a slot hole. This provides additional support for the inner plate and prevents any rotation or movement of the inner plate within the external casing.

Alternatively, the inner plate and/or the external casing may not comprise a hole. The inner plate and the external casing may not be directly connected. This requires the external casing to comprise at least one first aperture and at least one second aperture opposite the at least one first aperture, wherein each of the upright members extends through a first and second aperture and thereby extends through the rail channel. In this embodiment, the cross-section of at least one of the first and second aperture(s) may correspond to the cross-section of the upright member in the dimension perpendicular to the length of the rail channel, such that movement of the upright members in this dimension, and thus movement of the inner plate, is restricted.

The inner plate may extend the entire length of the rail channel. This allows upright members to be located along the entire length of the rail. The inner plate may therefore have a slot hole at each end of said inner plate, to secure said inner plate to the external casing at both ends of the rail. The external casing may therefore also have a slot hole at each end thereof.

The inner plate may be formed from metal, preferably steel, more preferably stainless steel. The inventors of the present invention have found that the inner plate and/or the external casing may be formed from steel, which is a significantly cheaper and stronger metal than aluminium (which is commonly used in the art for fence rails). It is known that steel is approximately four times cheaper than aluminium, and that it requires three times the amount of aluminium to have the equivalent strength of steel. Rails of the art which involve complex moulded arrangements (such as those disclosed in US2011155982) cannot be formed from steel. The inner plate of the invention is simpler than rails of the art and does not require any form of moulding. Thus, said inner plate can be formed from steel.

The upright members may be rotatable about their projections. This allows for the upright members to move relative to the rail, and as such permits use of the fence panel on an inclined surface.

The projection may comprise a screw with a screwhead. The screw is partially screwed into the upright member such that the screwhead is separated from the upright member. In this embodiment, the openings may each comprise an elongated hole, wherein each elongated hole comprises a section with a width greater than the diameter of the screwhead and a section with a width less than the diameter of the screwhead.

Alternatively, the projection may comprise a pin. Preferably, the pin is fixed and immovable on the upright member. This is simpler and cheaper than the spring-loaded pins in the art, as it is more expensive and challenging to manufacture an upright member comprising a spring loaded pin than an upright member comprising a fixed pin. However, the pin may be a spring-loaded pin. Alternatively, the pin may not be fixed on the upright member and may be loose. A loose pin may not be fixed to the upright member and instead, may extend through a hole in the upright member.

Preferably, the inner plate is not pressed against the upright members and is instead loosely connected thereto. Thus, the projection preferably does not press the inner plate against the upright members. This can improve the ease of rotation about the projection, as well as minimising damage to the component parts, which can increase corrosion.

The pin may be formed from steel, preferably galvanised steel or stainless steel.

The fence panel may comprise at least two rails, optionally at least three rails, optionally at least four rails. Additional rails provide extra support and stability to the fence panel, as well as improving its aesthetics. The fence panel may comprise two rails. The fence panel may comprise three rails. The fence panel may comprise four rails.

The fence panel may comprise an upper rail extending at or towards the top of the upright members. The fence panel may comprise a lower rail extending at or towards the bottom of the upright members. This improves the stability and the aesthetics of the fence panel.

Preferably, when the fence panel comprises at least two rails, the external casing of at least one rail comprises apertures on only one side of said external casing. In fence panel arrangements comprising at least two rails, one of the rails may be located at the top of the fence panel (for example, in FIG. 1), and thus be connected to the upper ends of the upright members.

Alternatively or additionally, one of the rails may comprise apertures only on one side of the external casing and may be located at the bottom of the fence panel, and thus be connected to the other end of the upright members. The rail may also be in contact with a surface. For the benefit of aesthetic appearance, in these embodiments the upright members do not extend all the way through the rail channel of the at least one rail located at the top and/or bottom of the fence panel, such that the ends of the upright members are located in the rail channel, thereby creating a flat edge along the top and/or bottom of the fence panel.

Furthermore, in these embodiments, the end of the upright members that is present in the rail channel may be in contact with the side of the external casing which is opposite the side comprising the at least one aperture. Alternatively, the end of the upright members may not be in contact with said side of the external casing, to permit rotation of the upright members about their projections.

The cross-section of the upright members may increase in size towards the end of said upright members. Preferably, the cross-sectional dimension perpendicular to the length of the rail channel increases. The greatest cross-sectional dimension of the upright members may be such that the end of the upright members is in contact with both the inner plate and the external casing. This prevents the external casing from rotating about the upright members, which can cause the inner plate to detach from the external casing. This feature may be particularly useful in embodiments wherein one of the rails is located at the top of the fence panel.

At least one rail of the fence panel may comprise an insert. This may be particularly useful in embodiments wherein said rail is located at the bottom of the fence panel. This insert may be positioned inside the external casing and interposed between the plurality of upright members and the side of the external casing furthest from the inner plate. The insert may be in contact with both a plurality of upright members and the side of the external casing furthest from the inner plate. The insert prevents the external casing from rotating about the upright members, which can cause the inner plate to detach from the external casing. The insert may extend along the entire length of the external casing. The insert may be formed from plastic.

Additionally or alternatively, the plurality of upright members may each comprise a second projection. The second projection may be positioned on the opposite side of the upright member to the side comprising the first projection. Preferably, the second projection is opposite the first projection. The second projection may comprise a screw with a screwhead. Alternatively, the second projection may comprise a pin.

The first projection and second projection may be connected via a screw plate, optionally a steel screw plate. Therefore, the plurality of upright members may each comprise at least one screw plate. The screw plate may be elongate in shape such that the length is several times greater than the width, optionally from about 4 to about 5 times greater. The length of the screw plate may be greater than the cross-section of the upright members in either dimension of said cross-section.

In one embodiment, the at least one screw plate comprises a hole and the second projection. The hole and the second projection may be positioned at opposite ends of the screw plate. The screw plate may be inserted into a hollow centre of the upright member such that the screw plate bends into a U-shape, and such that the second projection extends through an opening in the upright member. The first projection may then be connected through a hole in the upright member, and into the hole on the screw plate such that the screw plate is held in place.

Alternatively, the at least one screw plate may comprise the first projection and the second projection. The screw plate may be inserted into the upright member such that the screw plate bends into a U-shape, and such that the first projection extends through a first opening in the upright member, and the second projection extends into a second opening in the upright member The second projection prevents the external casing from rotating about the upright members, which otherwise can cause the inner plate to become detached from the external casing. This feature may therefore be particularly useful in embodiments wherein at least one of the rails is located at the top and/or bottom of the fence panel.

The lower rail may be located towards the bottom of the upright members but not at the ends thereof, such that the upright members extend through the rail (as shown in FIG. 1). The upper rail may be located towards the top of the upright members but not at the ends thereof, such that the upright members extend through the rail.

According to a second aspect of the present invention, there is provided a fence comprising:

- at least two adjacent fence posts;
- a plurality of upright members located between adjacent fence posts; and
- at least one rail extending between the adjacent fence posts and connected to each of said upright members;
- wherein the at least one rail comprises:
  - an external casing defining a rail channel and comprising at least one aperture, wherein each of the upright members extends through an aperture into the rail channel, and
  - an inner plate that extends along at least part of the length of the rail channel,
- wherein the inner plate is at least partly enclosed by the external casing, wherein the inner plate comprises a flat portion comprising a plurality of openings that rests against the upright members and two angled portions connected to opposite sides of the flat portion and extending away from the upright members and wherein the plurality of upright members each comprise a projection that extends into one of said openings to connect the upright member to the rail.

The external casing may be clamped to at least one of the fence posts. This may be achieved by having corresponding slot holes on both the external casing and a clamp, which are then screwed or bolted together. The clamp is then affixed to the fence post. The clamp may be screwed onto the fence post. The use of slot holes on both the external casing and the clamp permits rotation about this connecting joint, which allows for the fence to be racked.

Additionally or alternatively, the external casing may be bolted to at least one of the fence posts. The external casing may be bolted using self-drilling screws. All of the rails may be clamped to at least one of the fence posts and preferably are clamped to both fence posts. This is to ensure maximum strength and stability of the fence.

The fence posts may be formed from cold rolled metal. Preferably, the cold rolled metal has a thickness from about 1 mm to about 4 mm, more preferably about 2 mm.

The fence posts may have a rectangular or square cross-section. The fence posts may have a circular or oval cross-section.

At least one end of at least one of the fence posts may be connected to a surface. Both ends of the fence posts may be connected to a surface if the fence is used as part of a larger structure, for example to block an entrance in a building. Preferably, at least one end of all of the fence posts is connected to a surface. Preferably, the surface is terrain. The surface may be flat or inclined.

The end of at least one of the fence posts may be embedded in the surface. The fence posts may be embedded by any reasonable method, for example pushing the fence post into the surface or digging a hole for the fence post to be inserted into.

The end of at least one of the fence posts may comprise a base plate for affixing said fence posts to the surface. The base plate may be attached to the fence post using any reasonable means. The base plate may comprise a plurality of holes for screwing or bolting the base plate to the surface.

At least a portion of the fence may be racked. In particular, the fence may be racked when used on an inclined surface. The upright members may be rotated about the projection so that the upright members remain parallel to each other and parallel to the fence posts. However, the upright members are no longer perpendicular to the at least one rail in this embodiment. The racked fence may comprise a plurality of rails, wherein the distance between said rails is maintained upon racking, and the plurality of rails remain parallel to each other.

According to a third aspect of the present invention, there is provided a method for assembling the fence panel discussed above in which the projection comprises a screw with a screwhead, and the openings each comprise an elongated hole, wherein each elongated hole comprises a section with a width greater than the diameter of the screwhead and a section with a width less than the diameter of the screwhead, the method comprising the steps of:

a) sliding the inner plate at least part of the way into the rail channel of the external casing;
b) inserting each of a plurality of upright members through an aperture in the external casing and into the rail channel, such that the screw on each of the upright members aligns with the section of a corresponding elongated hole on the inner plate having a width greater than the diameter of the screwhead and such that the inner plate is interposed between the upright member and the screwhead;
c) sliding the inner plate further into the rail channel such that the screw on each of the upright members aligns with the section of the elongated hole having a width less than the diameter of the screwhead; and
d) securing the inner plate to the external casing.

This method of assembly may be termed the "slide and lock" mechanism.

According to a fourth aspect of the present invention, there is provided a method for assembling the fence panel discussed above in which the projection comprises a pin, the method comprising the steps of:

a) inserting the pin through a corresponding opening on the inner plate, thereby connecting each upright member to the inner plate; and
b) passing the plurality of upright members through the aperture of the external casing, such that the inner plate is moved inside the rail channel of the external casing.

This method of assembly may be termed the "push and lock" mechanism. The upright members may be inserted through the apertures on the external casing before they are connected to the inner plate. After they are connected to the inner plate, the external casing can be slid along the upright members such that the inner plate is positioned inside the rail channel.

The pin may be fixed on the upright members and so step (a) involves aligning said pins with the corresponding holes on the inner plate. Alternatively, the pin may be loose and so step (a) involves aligning a hole on the inner plate with a hole on the upright member and then inserting the pin through both holes.

The methods of assembly of the present invention are straightforward, require no complex tools or machinery (such as welding equipment), and can be done at a different location to that of manufacture.

According to a fifth aspect of the present invention, there is provided a method for installing the fence discussed above, comprising the steps of:

a) installing a first fence post;
b) attaching the fence panel discussed above to the first fence post; and
c) installing a second fence post and attaching the second fence post to the fence panel, or attaching a second fence post to the fence panel and installing the second fence post.

According to a sixth aspect of the present invention, there is provided a method for installing the fence discussed above, comprising the steps of:

a) installing a first and a second fence post; and
b) attaching the fence panel discussed above to the first and second fence posts.

The methods of installation of the present invention are straightforward, require no complex tools or machinery (such as welding equipment), and can be done at a different location to that of manufacture and/or assembly.

According to a seventh aspect of the present invention, there is provided a kit for assembling the fence discussed above, comprising:

at least two fence posts,
a plurality of upright members, and
at least one rail,
wherein the at least one rail comprises:
an external casing defining a rail channel and comprising at least one aperture, and
an inner plate capable of extending along at least part of the length of the rail channel, wherein the inner plate comprises a flat portion comprising a plurality of openings capable of resting against the upright members and two angled portions connected to opposite sides of the flat portion and capable of extending away from the upright members and wherein the plurality of upright members each comprise a projection.

For the avoidance of doubt, all features relating to the fence panel also relate, where appropriate, to the fence, the methods for assembling the fence, and the kit for assembling the fence and vice versa.

BRIEF DESCRIPTION OF DRAWINGS

The invention will now be more particularly described with reference to the following examples and figures, in which.

DETAILED DESCRIPTION

Figure 1:
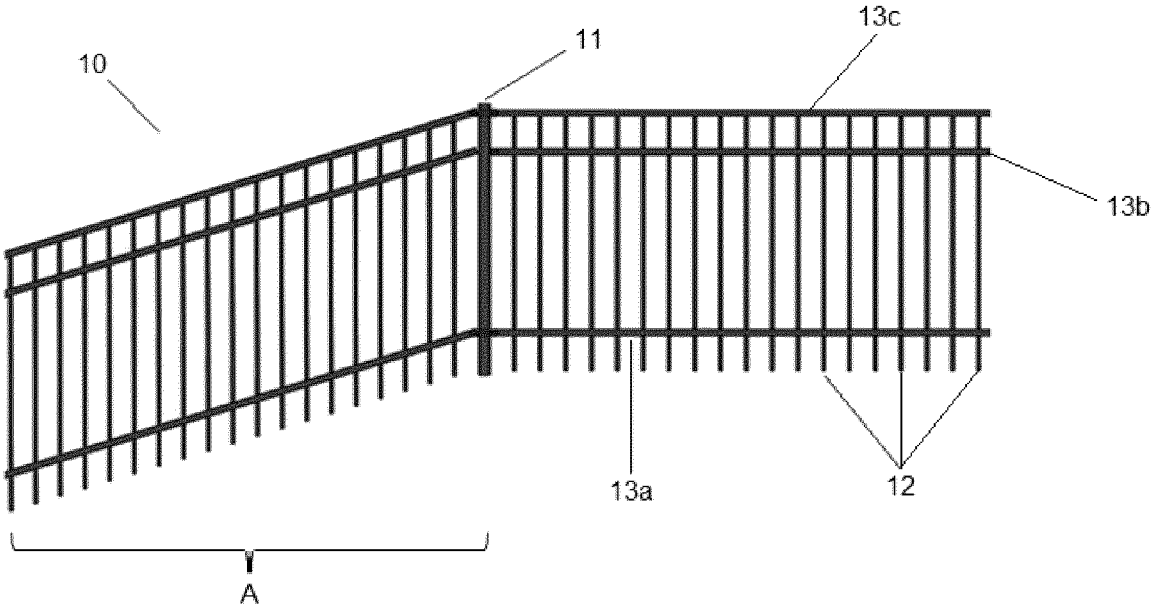
FIG. 1 illustrates a front elevation of the fence in accordance with one embodiment of the invention.

FIG. 1 illustrates a fence 10 according to an embodiment of the present invention. The fence 10 comprises a plurality of fence posts 11 (only one of which is shown), a plurality of upright members 12 and three rails 13*a*, 13*b*, 13*c*. The three rails 13*a*, 13*b*, 13*c* all extend between adjacent fence posts 11 and connect each of the upright members 12. The upright members extend through the lower two rails 13*a*, 13*b*, but do not extend through the upper rail 13*c*. Thus, the fence 10 has a flat top, defined by the upper rail 13*c*.

Section A of the fence 10 is racked, demonstrating how the fence can be used on inclined ground. In this section, the plurality of upright members 12 are parallel to the fence post 11, but are not perpendicular to the rails 13*a*, 13*b*, 13*c*. The rails 13*a*, 13*b*, 13*c* are all parallel to one another.

Figure 2:
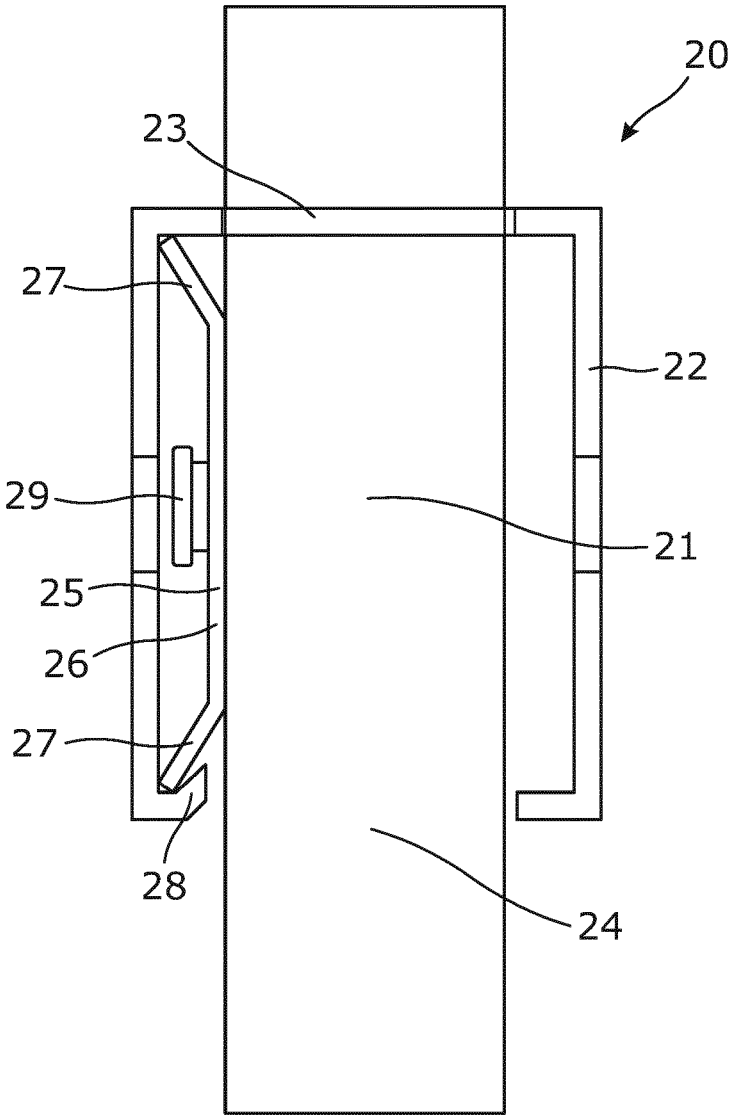
FIG. 2 illustrates a cross-section of an upright member and a rail in accordance with one embodiment of the invention.

FIG. 2 illustrates a cross-section of the joint between an upright member 21 and a rail according to an embodiment of the present invention. The rail comprises an external casing 22, which has a rectangular cross-section. The external casing 22 has a first aperture 23 on the top side of the casing, and a second aperture 24 on the bottom side of the casing. There is a plurality of first apertures 23 along the length of the external casing 22, whereas there is a single second aperture 24 extending the full length of the external casing 22. The upright member 21 extends all the way through the external casing 22.

The rail also comprises an inner plate 25. The inner plate 25 comprises a flat portion 26 that rests against the upright member 21 and two angled portions 27 connected to opposite sides of the flat portion, which extend away from the upright member 21. The two angled portions 27 are in contact with the corners of the external casing 22. The lower angled portion 27 is held in place in the external casing 22 by lip 28, which is angled upwards at 45°, away from the lower side of the external casing 22. The inner plate 25 is therefore interposed between the lip 28 and the side of the external casing 22 parallel to the upright member 21.

The inner plate 25 is connected to the upright member 21 by a steel pin 29 on the upright member 21, which extends into the corresponding opening on the inner plate 25, thus preventing any further translational movement. This pin can be fixed on the upright member or can extend through a hole in the upright member.

Figure 3:
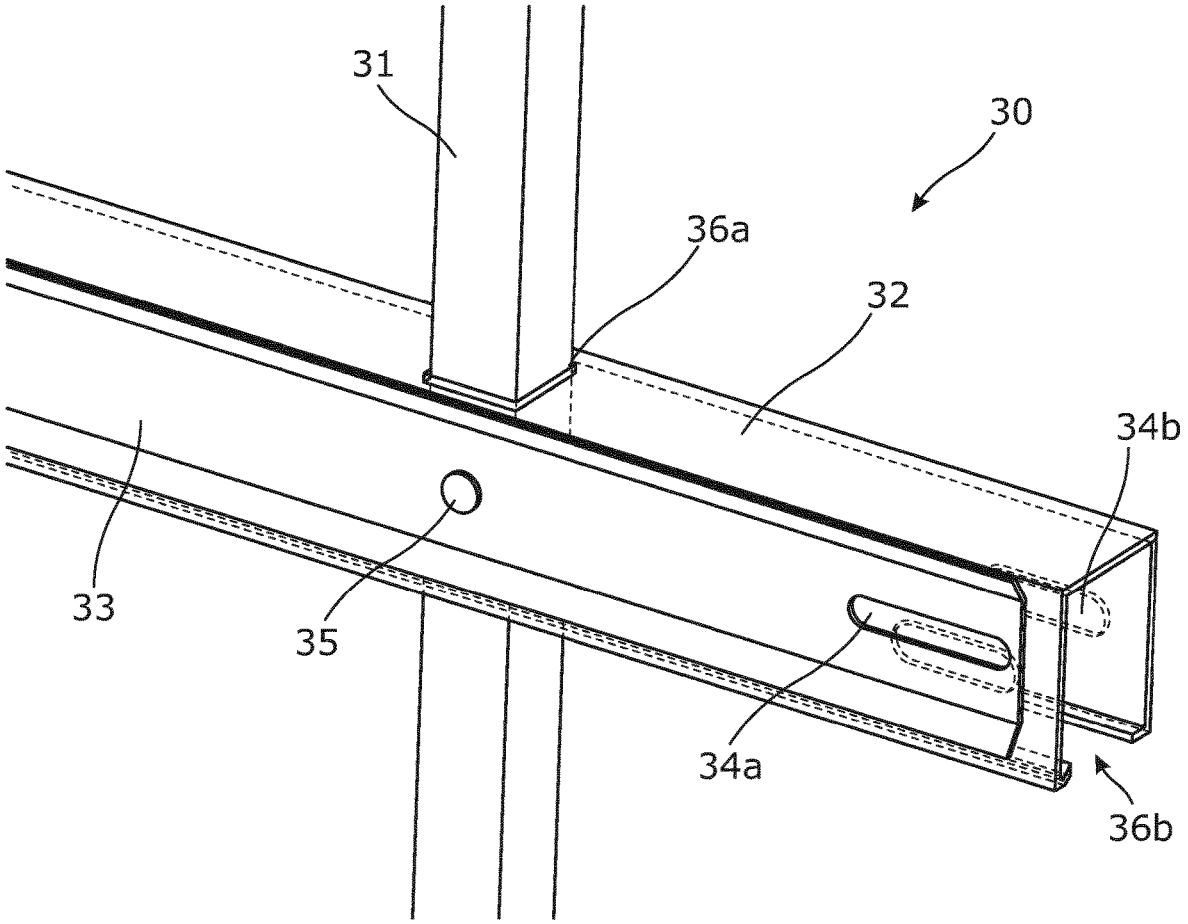
FIG. 3 illustrates a perspective view of an upright member and a rail in accordance with one embodiment of the invention.

FIG. 3 illustrates a perspective view of an upright member and a rail according to an embodiment of the present invention. The upright member 31 extends through the external casing 32 via opposed apertures 36*a*, 36*b* in the external casing 32. As with FIG. 2, the external casing 32 comprises a plurality of first apertures 36*a* along its length and a single second aperture 36*b*, which extends the full length of the external casing 32.

Inner plate 33 is connected to the external casing 32 and is secured by a slot hole 34*a* on the inner plate 33, which aligns with a slot hole 34*b* on the external casing 32. A conventional fastening means can then be used, such as a bolt or a screw, to connect the inner plate 33 to the external casing 32. The upright member 31 is connected to the inner plate 33 by a pin 35 on the upright member 31, which extends through an opening in the inner plate 33. This pin can be fixed on the upright member or can extend through a hole in the upright member.

Figure 4:
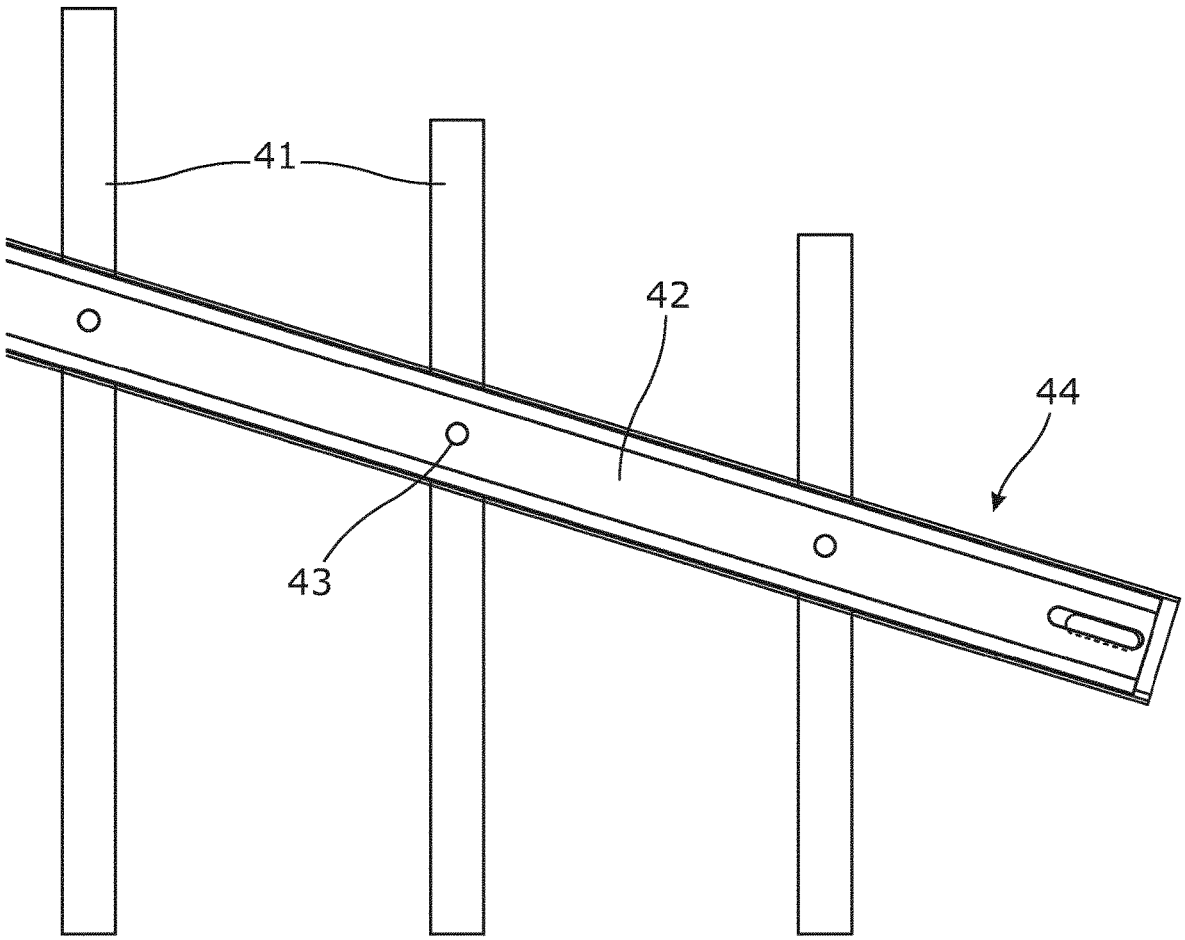
FIG. 4 illustrates a perspective view of a plurality of upright members and a rail in accordance with one embodiment of the invention.

FIG. 4 illustrates a perspective view of a plurality of upright members and a rail and demonstrates how a fence according to an embodiment of the present invention is able to rack. The plurality of upright members 41 may extend vertically atop an inclined terrain. Each of the upright members 41 is connected to the rail 44 by a pin 43 on the upright member 41, which extends through an opening in the inner plate 42. This pin can be fixed on the upright member or can extend through a hole in the upright member. The upright members 41 are free to rotate about said pin 43. The result of this rotation is that the rail 44 is no longer perpendicular to the upright members 41, whilst each of said upright members 41 are parallel to one another and to the fence posts (not shown). Thus, the fence can be used on sloping terrain.

Figure 5:
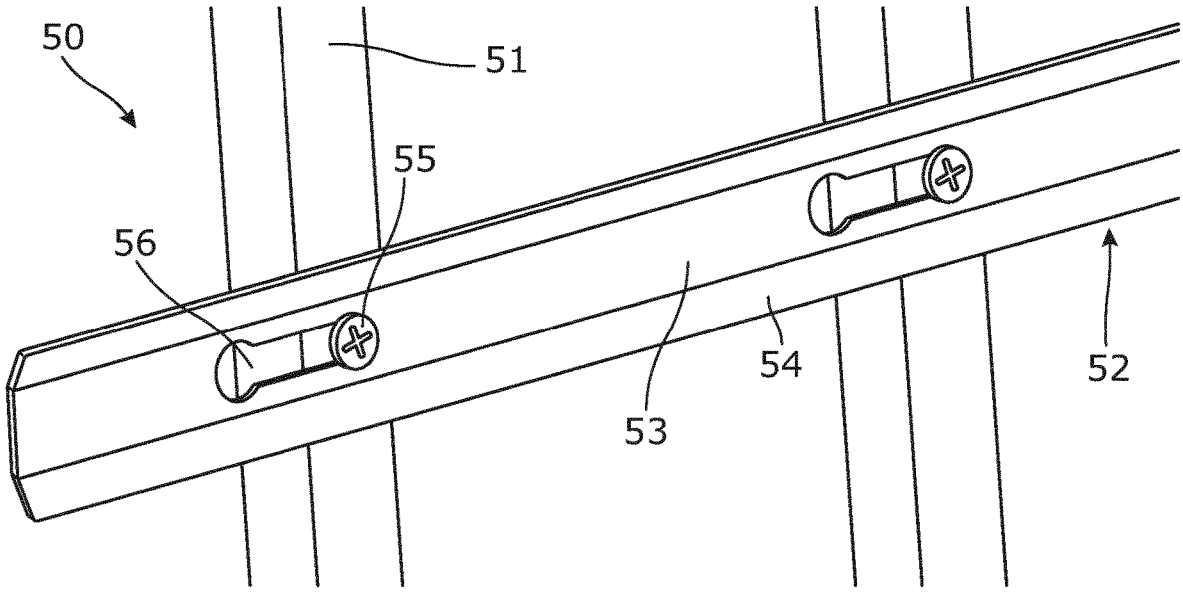
FIG. 5 illustrates a perspective view of two upright members and an inner plate in accordance with one embodiment of the invention.

FIG. 5 illustrates a perspective view of the connection between an upright member 51 and the inner plate 52 in accordance with one embodiment of the invention. The inner plate 52 comprises a flat portion 53 that rests against the upright member 51 and two angled portions 54 connected to opposite sides of the flat portion 53. The upright member 51 comprises a screw 55, which has been partially screwed into the upright member 51 such that the screwhead of the screw is separated from the upright member.

The inner plate 52 is interposed between the screwhead and the upright member 51, so that the upright member 51 is secured in place. This is achieved by passing the screwhead through an elongated hole 56 in the inner plate 52, which has a section with a width greater than the diameter of the screwhead. The inner plate 53 is then moved relative to the upright members 51 such that the screw is moved along the elongated hole 56 to a section in which the width of the elongated hole 56 is less than the diameter of the screwhead, thereby holding the upright member 51 in place as shown in FIG. 5. This method of connection may be termed a "slide and lock" mechanism.

Figure 6:
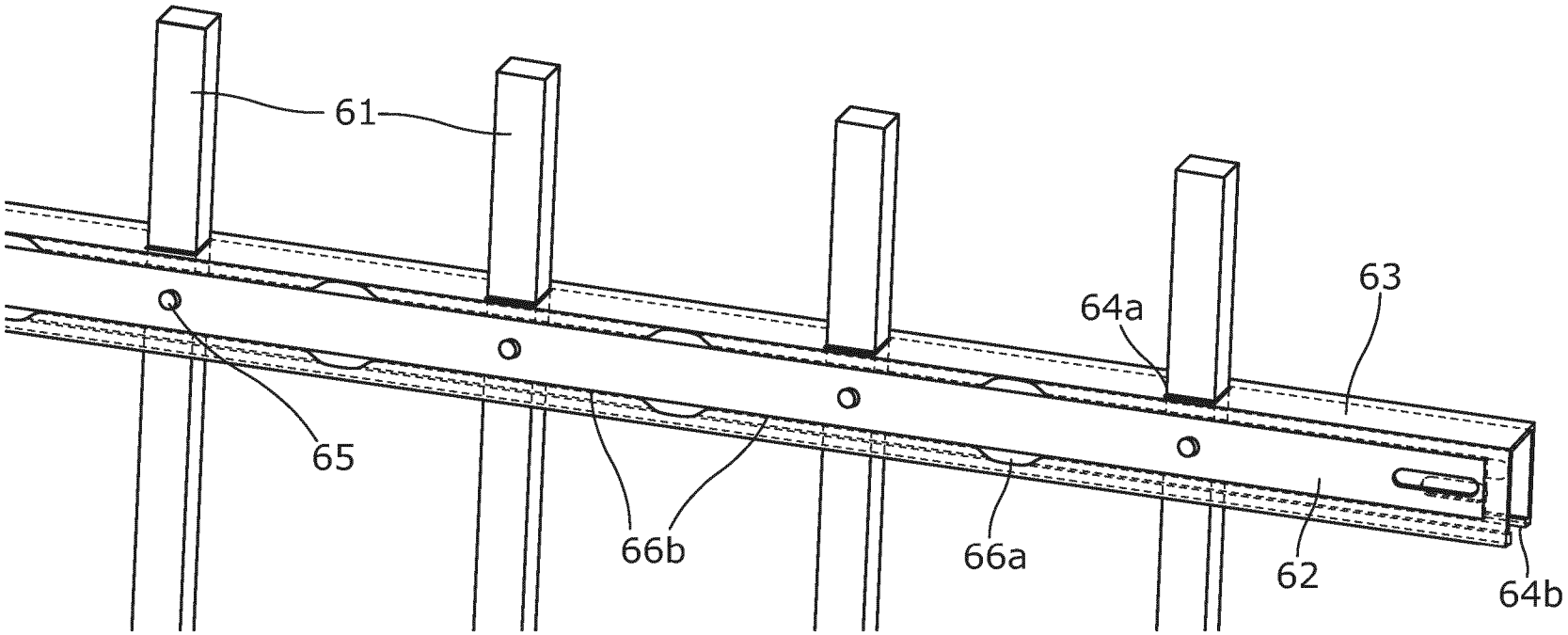
FIG. 6 illustrates a perspective view of a plurality of upright members and a rail in accordance with another embodiment of the invention.

FIG. 6 illustrates a perspective view of the connection between upright members 61 and the rail in accordance with another embodiment of the invention. The rail comprises inner plate 62 and external casing 63. The external casing comprises a plurality of first apertures 64*a* along its length and a single second aperture 64*b*, which extends the full length of the external casing 62. Each upright member 61 comprises a pin 65, which connects said upright member 61 to the inner plate 62 by extending through a corresponding opening on the inner plate 62. This pin can be fixed on the upright member or can extend through a hole in the upright member. This prevents any further translational movement of the upright member 61, permitting only rotational movement about the axis of the pin 65.

This method of assembly may be termed a "push and lock" mechanism, as the upright members 61 and inner plate 62, which are connected, are inserted upwards through the aperture 64*b* on the lower side of the external casing 63 and out through the aperture 64*a* on the upper side of the external casing 63, such that the inner plate 62 is positioned inside the rail channel of the external casing 63 and connected thereto. Thus, the inner plate 62 "locks" into place inside the rail channel defined by the external casing 63.

The inner plate in this embodiment varies in width along its length, comprising sections with a greater width 66*a* alternated with sections having a smaller width 66*b*. The width of the inner plate 62 varies gradually between the section of greater width 66*a* and the section of lesser width 66*b*, to create a wave strip shape. The inner plate 62 is only in contact with the external casing 63 at those sections where the width is greatest.

Figure 7:
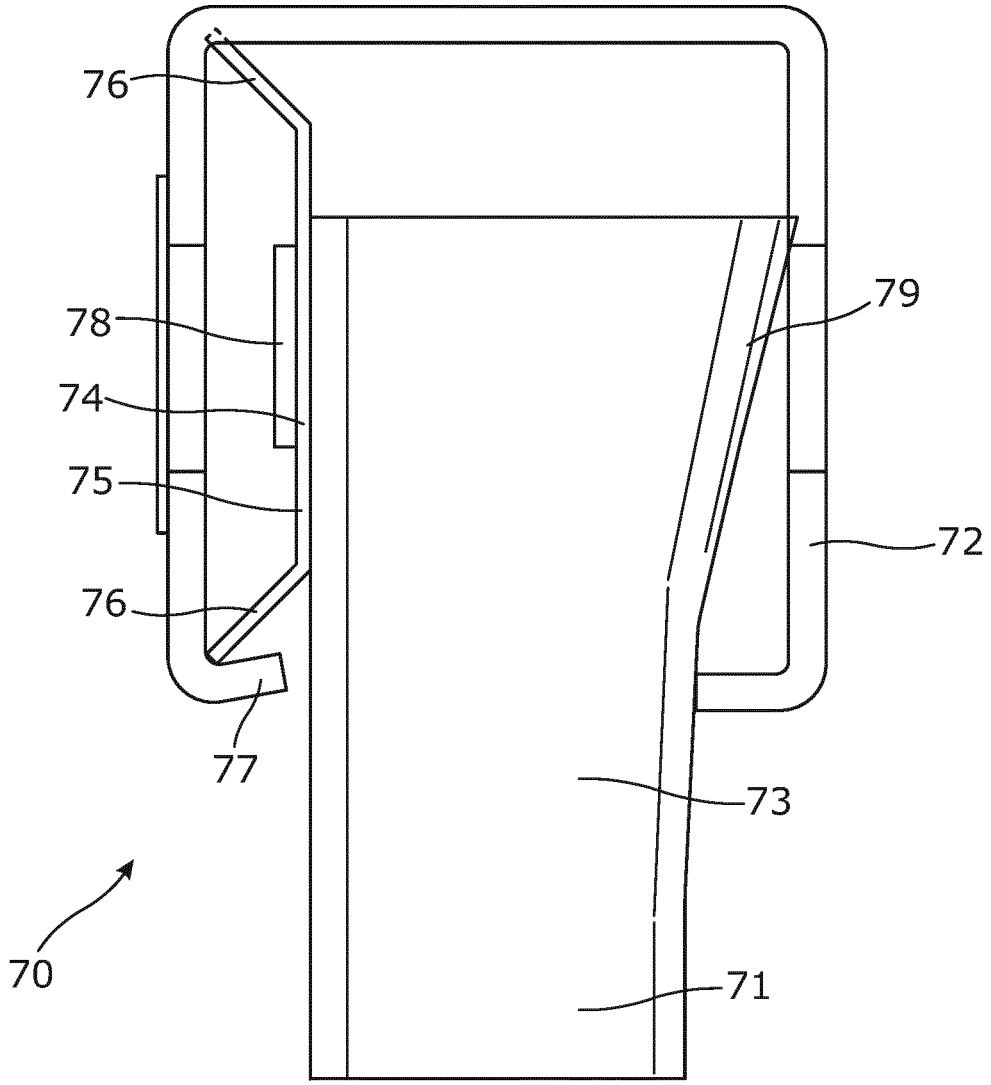
FIG. 7 illustrates a cross-section of an upright member and a rail in accordance with one embodiment of the invention.

FIG. 7 illustrates a cross-section of the joint between an upright member 71 and a rail according to an embodiment of the present invention. The rail comprises an external casing 72, which has a rectangular cross-section. The external casing 72 has an aperture 73 on the bottom side of the casing, but no aperture on the top side of the casing. Therefore, the upright member 71 does not extend all the way through the external casing 72 and, as such, this figure illustrates an embodiment in which the rail extends along the top of the upright member 71. The aperture 73 is a single aperture extending the full length of the external casing 72.

The rail also comprises an inner plate 74. The inner plate 74 comprises a flat portion 75 that rests against the upright member 71 and two angled portions 76 connected to opposite sides of the flat portion, which extend away from the upright member 71. The two angled portions 76 are in contact with the corners of the external casing 72. The lower angled portion 76 is held in place in the external casing 72 by lip 77, which is angled upwards at 10°, away from the lower side of the external casing 72. The inner plate 74 is therefore interposed between the lip 77 and the side of the external casing 72 parallel to the upright member 71.

The inner plate 74 is connected to the upright member 71 by a steel pin 78 on the upright member 71, which extends into the corresponding opening on the inner plate 74, thus preventing any further translational movement. This pin can be fixed on the upright member or can extend through a hole in the upright member.

The cross-section of the upright member 71 at the top 79 of said upright member 71 is greater than the cross-section of the rest of the length of the upright member 71. The dimension perpendicular to the length of the rail channel of the upright member 71 gradually increase in size, such that the size of the cross-section of the upright member 71 is greatest at the very top. The top of the upright member 71 contacts both the inner plate 74 and the side of the external casing 72 furthest from the inner plate.

Figure 8:
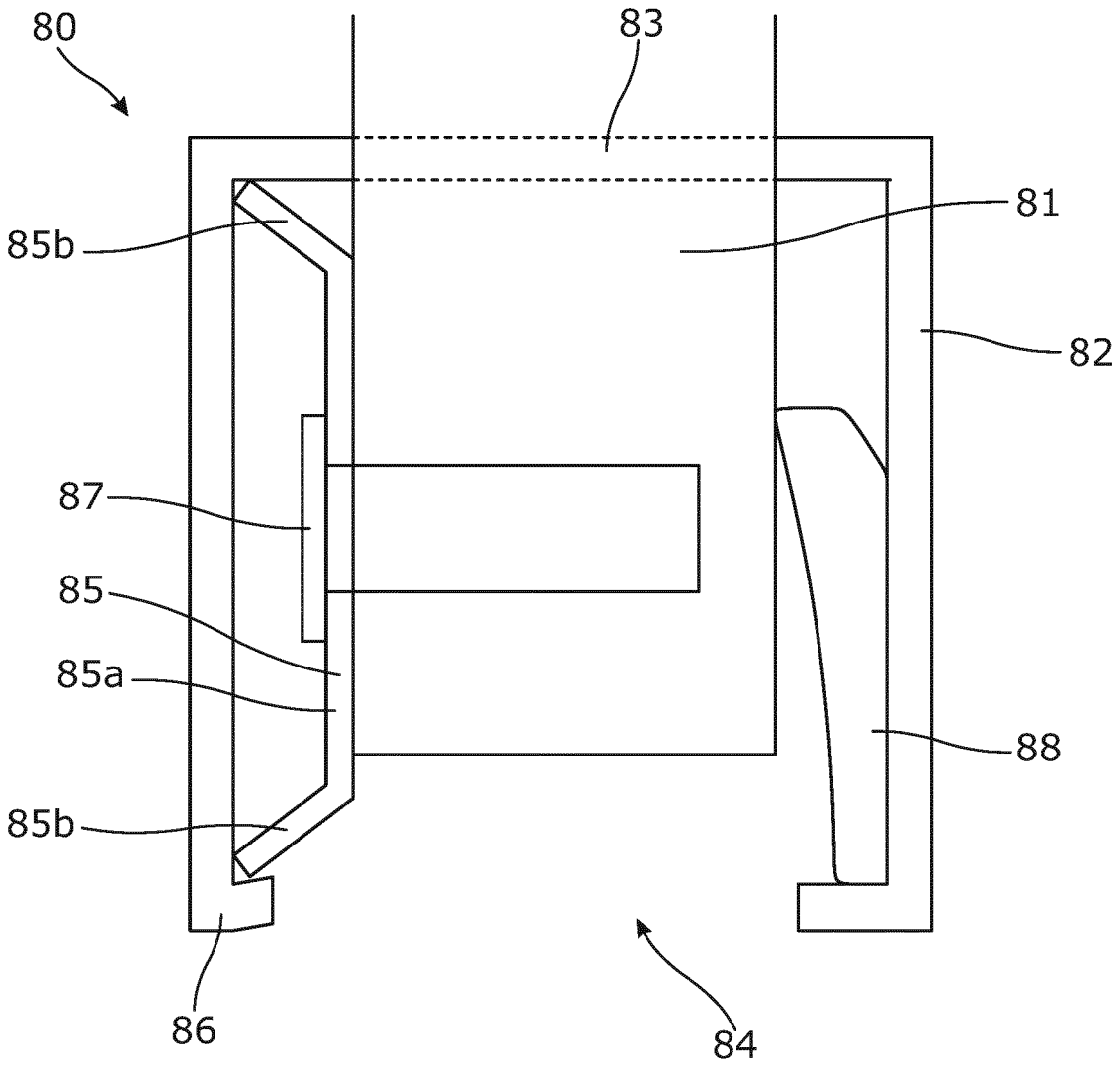
FIG. 8 illustrates a cross-section of an upright member and a rail in accordance with one embodiment of the invention.

FIG. 8 illustrates a cross-section of the joint between an upright member 81 and a rail according to an embodiment of the present invention. The rail comprises an external casing 82, which has a rectangular cross-section. The external casing 82 has a first aperture 83 on the top side of the casing and a second aperture 84 on the bottom side of the casing. There is a plurality of first apertures 83 along the length of the external casing 82, whereas there is a single second aperture 84 extending the full length of the external casing 82. The upright member extends through the first aperture 83 but not through the second aperture 84. Therefore, the upright member 81 does not extend all the way through the external casing 82. As such, this figure illustrates an embodiment in which the rail extends along the bottom of the upright member 81.

The rail also comprises an inner plate 85. The inner plate 85 comprises a flat portion 85*a* that rests against the upright member 81 and two angled portions 85*b* connected to opposite sides of the flat portion, which extend away from the upright member 81. The two angled portions 85*b* are in contact with the corners of the external casing 82. The lower angled portion 85*b* is held in place in the external casing 82 by lip 86, which is angled upwards at 10°, away from the lower side of the external casing 82. The inner plate 85 is therefore interposed between the lip 86 and the side of the external casing 82 parallel to the upright member 81.

The inner plate 85 is connected to the upright member 81 by a steel pin 87 on the upright member 81, which extends into the corresponding opening on the inner plate 85, thus preventing any further translational movement. This pin can be fixed on the upright member or can extend through a hole in the upright member.

The rail further comprises a plastic insert 88. The plastic insert 88 is interposed between upright member 81 and the external casing 82, and is shaped such that it is in contact with both the upright member 81 and the side of the external casing 82 furthest from the inner plate. The plastic insert 88 extends along the entire length of the external casing, and prevents the external casing 82 from rotating about the upright member 81.

Figure 9:
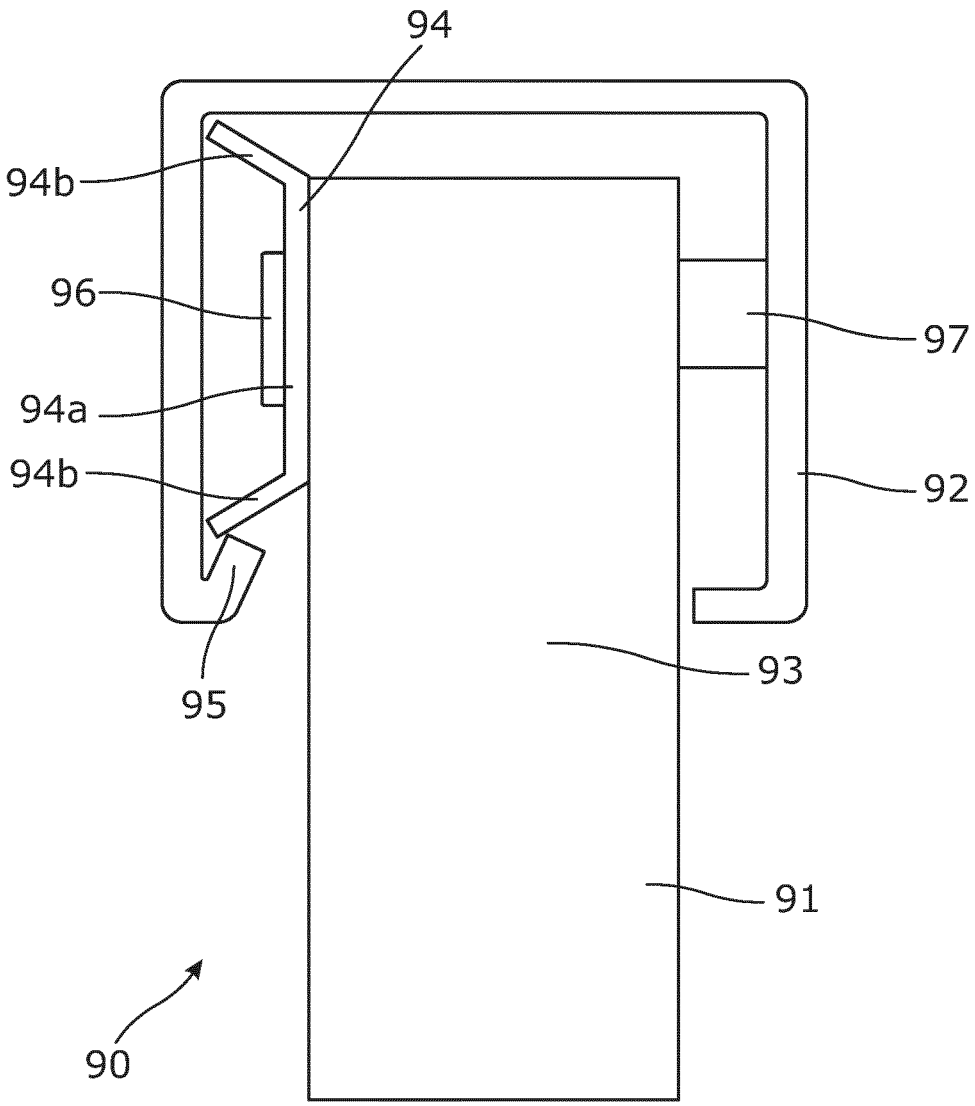
FIG. 9 illustrates a cross-section of an upright member and a rail in accordance with one embodiment of the invention.

FIG. 9 illustrates a cross-section of the joint between an upright member 91 and a rail according to an embodiment of the present invention. The rail comprises an external casing 92, which has a rectangular cross-section. The external casing 92 has an aperture 93 on the bottom side of the casing, but no aperture on the top side of the casing. Therefore, the upright member 91 does not extend all the way through the external casing 92 and, as such, this figure illustrates an embodiment in which the rail extends along the top of the upright member 91. The aperture 93 is a single aperture extending the full length of the external casing 92.

The rail also comprises an inner plate 94. The inner plate 94 comprises a flat portion 94*a* that rests against the upright member 91 and two angled portions 94*b* connected to opposite sides of the flat portion 94*a*, which extend away from the upright member 91. The two angled portions 94*b* are in contact with the corners of the external casing 92. The lower angled portion 94*b* is held in place in the external casing 92 by lip 95, which is angled upwards at 70°, away from the lower side of the external casing 92. The inner plate 94 is therefore interposed between the lip 95 and the side of the external casing 92 parallel to the upright member 91.

The inner plate 94 is connected to the upright member 91 by a steel pin 96 on the upright member 91, which extends into the corresponding opening on the inner plate 94, thus preventing any further translational movement. This pin can be fixed on the upright member or can extend through a hole in the upright member.

The upright member 91 further comprises a steel screw 97. The steel screw 97 is partially screwed into the upright member 91 such that the screwhead is separated from the upright member 91. The steel screw 97 projects from the side of the upright member opposite the side comprising the steel pin 96. The screwhead of the steel screw 97 is in contact with the external casing 92. This prevents the external casing 92 from rotating about the upright member 91, which otherwise can cause the inner plate 94 to become detached from the external casing 92.

Figure 10:
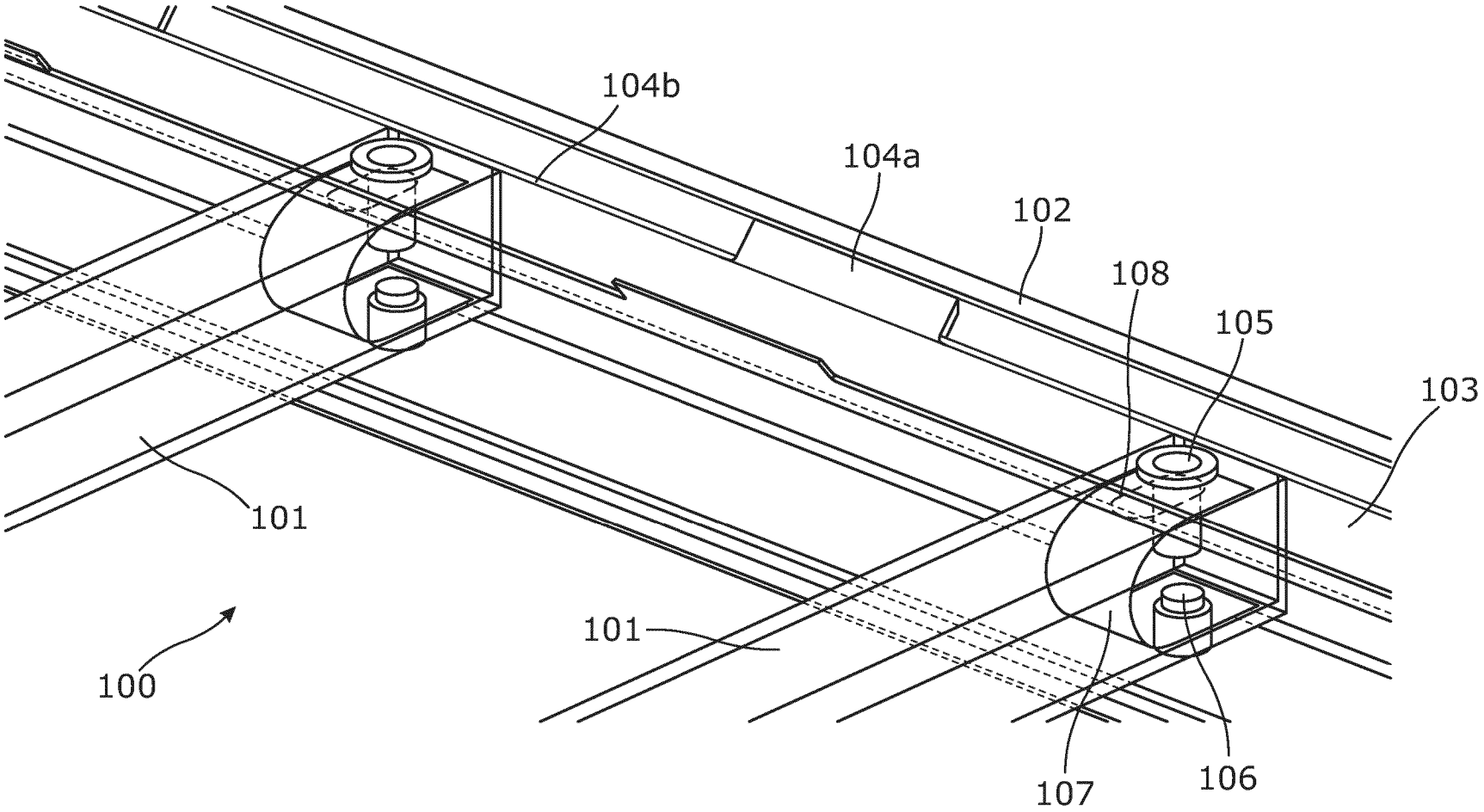
FIG. 10 illustrates a perspective view of two upright members and a rail in accordance with one embodiment of the invention.

FIG. 10 illustrates a perspective view of the connection between upright members 101 and the rail in accordance with an embodiment of the invention. The rail comprises external casing 102 and inner plate 103. Each upright member 101 comprises a first steel screw 105, which connects said upright member 101 to the inner plate 103 by extending through a corresponding opening on the inner plate 103 (not shown), such that the inner plate 103 is interposed between the screwhead of the first steel screw 105 and the upright member 101.

The inner plate in this embodiment varies in width along its length, comprising sections with a greater width 104*a* alternated with sections having a smaller width 104*b*. The inner plate 103 is only in contact with the external casing 102 at those sections where the width is greatest.

Each upright member 101 further comprises a second steel screw 106, which extends through an opening on said upright member 101 and contacts the external casing 102. The second steel screw 106 prevents the external casing 102 from rotating about the upright member 101, which can otherwise cause the inner plate 103 to become detached from the external casing 102.

The second steel screw 106 is connected to the first steel screw 105 via a screw plate 107. The screw plate 107 comprises the second steel screw 106 and a hole 108. The second steel screw 106 is screwed into the screw plate 107. During manufacture, the screw plate 107 is inserted internally into the upright member 101 such that the screw plate 107 bends into a U-shape, and such that the second steel screw 106 extends through an opening on the upright member 101. The first steel screw 105 may then be screwed through the upright member 101 and into hole 108 on the screw plate 107. This first steel screw 105 provides the projection with which the upright member 101 is connected to the inner plate 103, whilst also securing the screw plate 107 in place inside the upright member 101.

The invention claimed is:

1. A fence panel comprising:

a plurality of upright members, and at least one rail connected to each of said upright members, wherein the at least one rail comprises:

an external casing defining a rail channel and comprising at least one aperture, wherein each of the upright members extends through the at least one aperture into the rail channel, and an inner plate that extends along at least part of the length of the rail channel, wherein the inner plate is at least partly enclosed by the external casing, wherein the inner plate comprises a flat portion comprising a plurality of openings that rests against the upright members and two angled portions connected to opposite sides of the flat portion and extending away from said upright members and wherein the plurality of upright members each comprise a projection that extends into one of said openings to connect said upright member to the rail, and wherein the external casing comprises a lip that comprises a section angled towards the inside of the external casing and away from a lower side thereof, and wherein one of the angled portions of the inner plate rests in a channel formed by the lip; and wherein the inner plate comprises a slot hole to secure said inner plate to the external casing.

2. The fence panel according to claim 1, wherein the external casing comprises at least one first aperture and at least one second aperture opposite the at least one first aperture, wherein each of the upright members extends through the at least one first aperture and the at least one second aperture and thereby extends through the rail channel.

3. The fence panel according to claim 1, wherein the at least one aperture comprises a plurality of apertures such that each upright member extends through a different aperture of the plurality of apertures.

4. The fence panel according to claim 1, wherein the external casing comprises one aperture opposite the at least one aperture extending along at least part of the length thereof, such that all of the upright members extend through the same aperture.

5. The fence panel according to claim 1, wherein the cross-section of the at least one aperture is greater than the cross-section of an upright member extending therethrough.

6. The fence panel according to claim 1, wherein the lip is connected to the lower side of the external casing and is angled towards the inside of the external casing, away from said lower side and partly over said at least one aperture.

7. The fence panel according to claim 1, wherein the inner plate comprises portions having a first width alternating with portions having a second width, wherein the first width is greater than the second width.

8. The fence panel according to claim 7, wherein the width of the inner plate varies gradually between a portion having a first width and a portion having a second width, thereby forming a wave strip shape.

9. The fence panel according to claim 1, wherein the inner plate extends the entire length of the rail channel.

10. The fence panel according to claim 1, wherein the fence panel comprises at least two rails.

11. The fence panel according to claim 10, wherein the external casing of at least one rail comprises the at least one apertures on only one side of said external casing.

12. The fence panel according to claim 1, wherein the plurality of upright members each comprise a first projection and a second projection, wherein the first projection extends into one of the openings on the inner plate to connect the upright member to the rail, and the second projection is positioned on the opposite side of the upright member to the side with the first projection.

13. The fence panel according to claim 1, wherein the projection comprises a screw with a screwhead, and the openings each comprise an elongated hole, wherein each elongated hole comprises a section with a width greater than the diameter of the screwhead and a section with a width less than the diameter of the screwhead.

14. The fence panel according to claim 1, wherein the projection comprises a pin.

15. A fence comprising:

at least two adjacent fence posts, and the fence panel according claim 1, the fence panel comprising a plurality of upright members located between adjacent fence posts, and at least one rail extending between the adjacent fence posts.

16. The fence according to claim 15, wherein the external casing is clamped to at least one of the fence posts and/or wherein the external casing is bolted to at least one of the fence posts.

17. The fence according to claim 15, wherein at least one end of at least one of the fence posts is connected to a surface.

18. The fence according to claim 15, wherein the end of at least one of the fence posts is embedded in the surface, or wherein the end of at least one of the fence posts comprises a base plate for affixing said fence posts to the surface.

19. A method of installing a fence according to claim 15, comprising the steps of:

a) installing a first fence post;

b) attaching the fence panel according to claim 1 to the first fence post; and c) installing a second fence post and attaching the second fence post to the fence panel, or attaching a second fence post to the fence panel and installing the second fence post.

20. A method of installing a fence according to claim 15, comprising the steps of:

a) installing a first and a second fence post; and b) attaching the fence panel according to claim 1 to the first and second fence posts.

21. A kit for assembling the fence according to claim 15, comprising:

at least two fence posts, a plurality of upright members, and at least one rail, wherein the at least one rail comprises:

an external casing defining a rail channel and comprising at least one aperture, and an inner plate capable of extending along at least part of the length of the rail channel, wherein the inner plate comprises a flat portion comprising a plurality of openings capable of resting against the upright members and two angled portions connected to opposite sides of the flat portion and capable of extending away from the upright members and wherein the plurality of upright members each comprise a projection.

22. A method for assembling the fence panel according to claim 1, wherein the projection comprises a screw with a screwhead, and the openings each comprise an elongated hole, wherein each elongated hole comprises a section with a width greater than the diameter of the screwhead and a section with a width less than the diameter of the screwhead, comprising the steps of:

a) sliding the inner plate at least part of the way into the rail channel of the external casing;

b) inserting each of a plurality of upright members through an aperture in the external casing and into the rail channel, such that the screw on each of the upright members aligns with the section of a corresponding elongated hole on the inner plate having a width greater than the diameter of the screwhead and such that the inner plate is interposed between the upright member and the screwhead;

c) sliding the inner plate further into the rail channel such that the screw on each of the upright members aligns with the section of the elongated hole having a width less than the diameter of the screwhead; and d) securing the inner plate to the external casing.

23. A method for assembling the fence panel according to claim 1, wherein the projection comprises a pin, comprising the steps of:

a) inserting the pin through a corresponding opening on the inner plate, thereby connecting each upright member to the inner plate; and b) passing the plurality of upright members through the aperture of the external casing, such that the inner plate is moved inside the rail channel of the external casing.

24. A fence panel comprising:

a plurality of upright members, and at least one rail connected to each of said upright members, wherein the at least one rail comprises:

an external casing defining a rail channel and comprising at least one aperture, wherein each of the upright members extends through the at least one aperture into the rail channel, and an inner plate that extends along at least part of the length of the rail channel, wherein the inner plate is at least partly enclosed by the external casing, wherein the inner plate comprises a flat portion comprising a plurality of openings that rests against the upright members and two angled portions connected to opposite sides of the flat portion and extending away from said upright members and wherein the plurality of upright members each comprise a projection that extends into one of said openings to connect said upright member to the rail, and wherein the external casing comprises a lip that comprises a section angled towards the inside of the external casing and away from a lower side thereof, and wherein one of the angled portions of the inner plate rests in a channel formed by the lip, and wherein the plurality of upright members each comprise the projection that extends into one of the openings on the inner plate to connect the upright member to the rail, and a second projection is positioned on the opposite side of the upright member to the side with the projection.

25. A fence panel comprising:

a plurality of upright members, and at least one rail connected to each of said upright members, wherein the at least one rail comprises:

an external casing defining a rail channel and comprising at least one aperture, wherein each of the upright members extends through the at least one aperture into the rail channel, and an inner plate that extends along at least part of the length of the rail channel, wherein the inner plate is at least partly enclosed by the external casing, wherein the inner plate comprises a flat portion comprising a plurality of openings that rests against the upright members and two angled portions connected to opposite sides of the flat portion and extending away from said upright members and wherein the plurality of upright members each comprise a projection that extends into one of said openings to connect said upright member to the rail, and wherein the external casing comprises a lip that comprises a section angled towards the inside of the external casing and away from a lower side thereof, and wherein one of the angled portions of the inner plate rests in a channel formed by the lip, and wherein the projection comprises a screw with a screwhead, and the openings each comprise an elongated hole, wherein each elongated hole comprises a section with a width greater than the diameter of the screwhead and a section with a width less than the diameter of the screwhead.

* * * * *